United States Patent [19]

Miyaki et al.

[11] Patent Number: 4,753,212

[45] Date of Patent: Jun. 28, 1988

[54] HIGH-PRESSURE FLUID CONTROL SOLENOID VALVE ASSEMBLY WITH COAXIALLY ARRANGED TWO VALVES

[75] Inventors: Masahiko Miyaki, Oobu; Noritaka Ibuki, Oogaki; Takio Tani; Atsusi Taguchi, both of Kariya; Kazuo Shinoda, Toyota; Hiroshi Koide, Okazaki; Fumiaki Kobayashi, Toyota, all of Japan

[73] Assignees: Nippondenso Co., Ltd., Kariya; Toyota Jidosha Kabushiki Kaisha, Toyota, both of Japan

[21] Appl. No.: 846,074

[22] Filed: Mar. 31, 1986

[30] Foreign Application Priority Data

Apr. 1, 1985 [JP] Japan ..... 60-68847

[51] Int. Cl.[4] ..... F02M 39/00

[52] U.S. Cl. ..... 123/506; 123/458; 123/179 L; 251/30.04; 251/44

[58] Field of Search ..... 123/506, 458, 449, 179 L; 251/30.04, 44

[56] References Cited

U.S. PATENT DOCUMENTS

| | | | |
|---|---|---|---|
| 2,251,441 | 8/1941 | Dillman | 251/30.04 |
| 3,858,841 | 1/1975 | Haynes | 251/30.03 |
| 3,903,919 | 9/1975 | Zeuner | 251/44 |
| 3,977,649 | 8/1976 | Zeuner | 251/30.02 |
| 4,201,362 | 5/1980 | Nishimi | 251/44 |
| 4,305,566 | 12/1981 | Grawunde | 251/44 |
| 4,475,690 | 10/1984 | Hascher-Reichl et al. . | |
| 4,480,619 | 11/1984 | Igashira et al. . | |

FOREIGN PATENT DOCUMENTS

| | | |
|---|---|---|
| 0076459 | 4/1983 | European Pat. Off. . |
| 0139400 | 5/1985 | European Pat. Off. . |
| 0163369 | 12/1985 | European Pat. Off. . |
| 51-34936 | 9/1976 | Japan . |
| 59-211724 | 11/1984 | Japan . |
| 59-211757 | 11/1984 | Japan . |
| 2004943 | 4/1979 | United Kingdom . |
| 2133479 | 7/1984 | United Kingdom . |

*Primary Examiner*—Carl Stuart Miller

*Attorney, Agent, or Firm*—Cushman, Darby & Cushman

[57] ABSTRACT

A high-pressure fluid control solenoid valve assembly for use with a spill type fuel injection pump of an internal combustion engine, comprises an actuator portion (101) including a solenoid (8, 9), a stator (7) and an armature (14), and a valve portion (102) including a pilot valve (40, 41) and a main valve (42, 43) where the valve portion (102) is spaced apart from the actuator portion (101) and is responsive to the movement of the armature (14) via a rod (14) connected to the armature (14) and extends axially in a bore of the stator (7) which is cylindrical hollow. The pilot valve (40, 41) is coaxial with and telescopically received in the main valve (42, 43) so that two fluid chambers (54, 51) are formed inside and outside, respectively a spool (42) of the main valve such that the main valve is continuously kept closed irrespective of the fluid pressure in these chambers as long as the pilot valve is closed. The pilot valve comprises a needle (40) which is arranged to be pressed by the rod (13) to close the pilot valve on energization of the solenoid (8, 9), where the needle (40) is normally biased in valve-opening direction. On deenergization, the pilot valve opens causing the main valve to spill fuel thus terminating the fuel injection.

15 Claims, 3 Drawing Sheets

HIGH-PRESSURE FLUID CONTROL SOLENOID VALVE ASSEMBLY WITH COAXIALLY ARRANGED TWO VALVES

BACKGROUND OF THE INVENTION

1. Field of the Invention

This invention relates to a fluid control solenoid valve used for controlling the quantity of fuel to be injected into an internal combustion engine, and more particularly to such a solenoid valve used for spilling fuel under high pressure at an arbitrary timing in each cycle of operation of a fuel injection pump through which fuel is injected into cylinders of engine, such as a diesel engine.

2. Prior Art

The concept of injection amount control system of the type arranged to let high pressure fuel directly spill by way of a solenoid valve is known in the art of fuel injection into an internal combustion engine, typically a diesel engine. For instance, Japanese Patent Provisional publication No. 51-34936 discloses such fuel injection system for a diesel engine. According to the above-mentioned system a solenoid valve is provided in a passage communicating between a high pressure chamber of a pump and low pressure side, and the solenoid valve is opened after either an arbitrary given period of time or the rotation of a cam angle from an instant of a reference angle signal generated at a given timing within an operation cycle of the pump so that high pressure fuel is spilled to control the amount of injection fuel. This known system is simple in construction when compared with conventional mechanical governor used for controlling fuel injection amount by positioning rack or sleeve, and is also suitable for electronic control.

The above-mentioned high pressure direct spill system has a problem in connection with how to maintain valve-closed state withstanding the pump chamber pressure of a diesel injection pump which is subjected to at least 200 to 400 kg/cm$^3$, and how to readily manufacture a small-sized solenoid valve of high reliability which operates with response of 200 Hz at maximum depending on engine rpm. Furthermore, such a solenoid should have a structure so that valve is closed on energization, i.e. an acting direction opposite to normal fluid control valve, such that fuel injection is terminated when no electrical signal is applied due to breaking of wire or the like thereby stopping a motor vehicle in a safe manner. Although a solenoid valve with quick response was proposed in Patent Publication No. 59-211724, this solenoid valve does not have a structure of closing the valve on energization.

Although a solenoid valve of the type arranged to close on energization is known from Japanese Patent Provisional publication Nos. 59-211724 and 59-211757 as well as U.S. Pat. No. 4,480,619, the diameter of a needle arranged to push a ball valve head is necessarily smaller than the diameter of a valve seat associated with the ball valve, and thus such valve structure is difficult to treat fluid under high pressure because of low reliability.

SUMMARY OF THE INVENTION

The present invention has been developed in order to remove the above-described drawbacks inherent in the conventional solenoid valve used in direct spill system for injecting fuel under high pressure into an intenral combustion engine.

It is, therefore, an object of the present invention to provide a new and useful solenoid valve or valve assembly with which various problems inherent in the conventional fluid control solenoid valves are satisfactorily resolved.

The present invention has been made to resolve the above-mentioned problem of the high pressure direct spill system, and contemplates to provide fluid control solenoid valve which is capable of controlling injection amount by direct spill system using a solenoid valve, and According to a feature of the present invention a solenoid valve assembly for use with direct spill type fuel injection system is provided which solenoid valve assembly is small in size and is capable of withstanding high pressure, while the solenoid valve assembly shows satisfactorily quick response and high reliability.

Another remarkable feature of the present invention is that the solenoid valve is of the type arranged to open on deenergization of the same so as to prevent possible dangerous situation.

In accordance with the present invention there is provided a high-pressure fluid control solenoid valve assembly for opening and closing high pressure fluid passage, comprising: an electromagnetic actuator portion having an armature, a winding, and a stator, which act as an electromagnetic solenoid and form a magnetic circuit; and a valve portion which interrupts flow of fluid under high pressure, said valve portion being spaced apart from said electromagnetic actuator portion, said valve portion having a first valve functioning as a pilot valve of small flow rate and a second valve functioning as a main valve of large flow rate, said first valve being biased normally in opening direction and said second valve being biased normally in closing direction, a hydraulic chamber being provided where one wall is made by said second valve, said hydraulic chamber communicating via an orifice provided to said second valve with an upper stream portion from a seat portion of said second valve, said second valve being biased in closing direction by the hydraulic pressure of said hydraulic chamber; said solenoid valve assembly being formed such that the movement of said armature being transmitted to said first valve by way of a rod-like member fixed to said armature so as to perform unitary movement, said rod-like member being movable within a guide hole made at the center of said stator portion, said high pressure fluid passage being closed with said first valve being closed on energization of said winding and said high pressure fluid passage being opened with said first and second valves being opend on deenergization of the same.

In accordance with the present invention there is also provided a high-pressure fluid control solenoid valve assembly for opening and closing high pressure fluid passage, comprising: a solenoid unit having a stator, a coil associated with said stator, and an armature arranged to be attracted toward said stator when said coil is energized; and a valve unit axially spaced from said solenoid unit and responsive to the movement of said armature, said valve unit having; a pilot valve of small flow rate having a pilot valve spool with a pilot valve head at one end thereof and a pilot valve body with a pilot valve seat, said pilot valve spool being slidably received in said pilot valve body so that said pilot valve head comes into contact with said pilot valve seat to close said pilot valve, said pilot valve spool being biased normally in valve-opening direction by a spring; a main valve of large flow rate having a main valve spool with a main valve head at one end thereof and a main valve body with a main valve seat, said main valve spool being slidably received in said main valve body so that said main valve head comes into contact with said main valve seat to close said main valve, said main valve spool being biased normally in valve-closing direction by another spring; at least a portion of said pilot valve body being received in an axial bore of said main valve spool such that a first fluid chamber is formed between an outer surface of said pilot valve body and an inner surface of said main valve spool, said first fluid chamber being communicating via an orifice made in said main valve head with a second fluid chamber defined by said main valve head and bottom of an axial bore of said main valve body, said second fluid chamber being communicating with fluid source to receive fluid under high pressure so that said first and second fluid chambers are filled with fluid when said pilot valve is being closed, said main valve seat having a diameter smaller than the diameter of said first fluid chamber so that said main valve spool is biased in valve-closing direction by the difference in fluid pressure between said first and second fluid chambers; the movement of said armature being transmitted to said first valve by way of a rod-like member fixed to said armature so as to perform unitary movement, said rod-like member being movable within a guide hole made at the center of said stator, said high pressure fluid passage being closed with said first valve being closed on energization of said winding and said high pressure fluid passage being opened with said first and second valves being opend on deenergization of the same.

In accordance with the present invention there is further provided a fuel injection apparatus with an improved solenoid valve assembly for use with an internal combustion engine, said fuel injection apparatus comprising: a distributor pump for injecting fuel from a fuel source into one or more cylinders of said internal combustion engine through compressign of fuel with a plunger driven in synchronism with engine rotation; reference angle signal generating means responsive to the movement of said plunger; an electronic control unit responsive to said reference angle signal for producing an output signal with which fuel amount to be injected is determined; and a high-pressure fluid control solenoid valve assembly for opening and closing high pressure fluid passage in said distributor pump, said solenoid valve assembly having: an electromagnetic actuator portion having an armature, a winding, and a stator, which act as an electromagnetic solenoid and form a magnetic circuit; and a valve portion which interrupts flow of fluid under high pressure, said valve portion being spaced apart from said electromagnetic actuator portion, said valve portion having a first valve functioning as a pilot valve of small flow rate and a second valve functioning as a main valve of large flow rate, said first valve being biased normally in opening direction and said second valve being biased normally in closing direction, a hydraulic chamber being provided where one wall is made by said second valve, said hydraulic chamber communicating via an orifice provided to said second valve with an upper stream portion from a seat portion of said second valve, said second valve being biased in closing direction by the hydraulic pressure of said hydraulic chamber; said solenoid valve assembly being formed such that the movement of said armature being transmitted to said first valve by way of a rod-like member fixed to said armature so as to perform unitary movement, said rod-like member being movable within a guide hole made at the center of said stator portion, said high pressure fluid passage being closed with said first valve being closed on energization of said winding and said high pressure fluid passage being opened with said first and second valves being opend on deenergization of the same.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
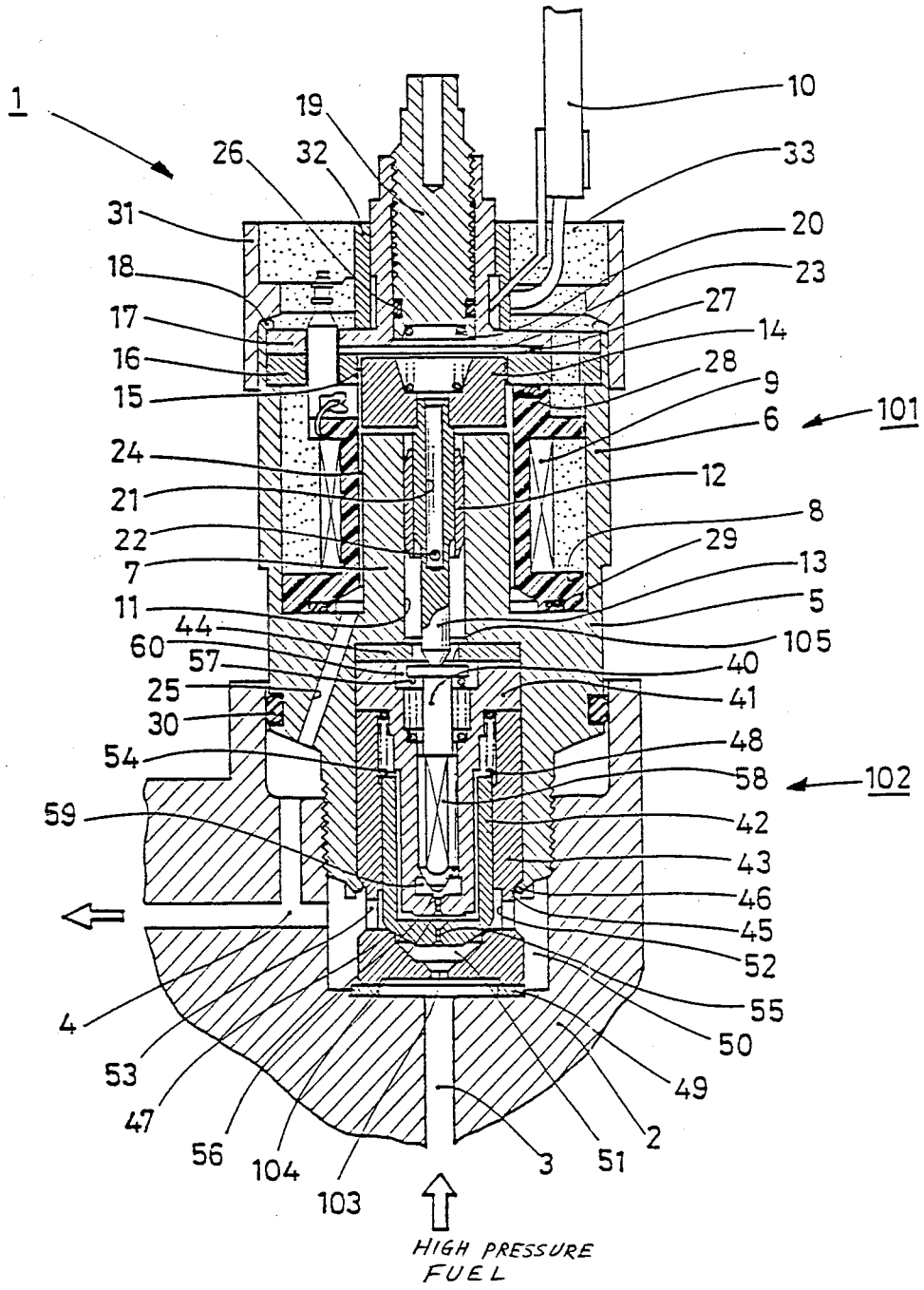
FIG. 1 is a cross-sectional view of a solenoid valve assembly according to an embodiment of the present invention.

Referring now to FIG. 1 of the drawings, a schematic cross-sectional view of an embodiment of the solenoid valve assemly according to the present invention is shown. The solenoid valve assembly generally denoted at the reference 1 is mounted on a distributor head 2 of a distribution type fuel injection pump. A high pressure passage 3 communicates with a pump chamber of an unshown plunger pump, while a spill passage 4 communicates with an unshown pump housing of low pressure. The solenoid valve assembly 1 is generally cylindrical, and various forming parts are installed in a housing 5 which also functions as a member forming a magnetic circuit of an electromagnetic solenoid. At an upper portion of the housing 5 is installed an electromagnetic actuator portion 101 which operates as an electromagnetic solenoid, and at a lower portion of the housing 5 is installed a valve portion 102 which interrupts flow of fluid under high pressure.

Now the structure of the electromagnetic actuator portion 101 will be described. An upper outer cylindrical portion of the housing 5 forms a yoke portion 6 of the electromagnetic solenoid, and an upper inner cylindrical portion of the same forms a stator portion 7 of the electromagnetic solenoid. Between the yoke portion 6 and the stator portion 7 is fitted an electromagnetic solenoid comprising a coil bobbin 8 formed of a synthetic resin, and a winding 9. The winding 9 is connected via lead wires 10 to an unshown electronic control apparatus for receiving driving signals with which the solenoid is energized. At an axis portion of the stator portion 7 is made a guide hole 11 in which bushing member 12 made of a hard material is fixed after being inserted therein with pressure. By the bushing member 12 is supported a shaft-shaped rod-like member 13 to be slidable axially. The rod-like member 13 is made of a nonmagnetic material, and its sliding surface and a lower end which comes into contact with a valve member are hardened. At an upper portion of the rod-like member 13 is fixed an annular armature 14 which is positioned so as to face an upper end of the stator portion 7. Around the armature 14 is provided an annular stator plate 16 with a given circumferential space therebetween. The stator plate 16 and a top plate 17 are securely fixed to the housing 5 with a flange portion 18 of an upper portion of the yoke 6 being calked. The stator plate 16 and the yoke portion 6 are magnetically coupled, and a magnetic circuit for the winding 9 is such that flux returns, via the stator portion 7 fitted into the coil bobbin 8, space, the armature 14, circular gap 15, the stator plate 16, yoke portion 16, to the stator portion 7. The armature 14 is attracted to the stator portion 7 on energization of the winding 9.

At a center portion of the top plate 17 is threaded so that an adjusting screw 19 is screwed thereinto. Between the adjusting screw 19 and the armature 14 is provided a compression spring 20 which biases the armature 14 and the rod-like member 13 downwardly in the drawing. This spring 20 is equivalent to a first spring biasing a pilot valve, which will be described hereinlater, in a releasing direction, and will be referred to as a second spring hereinafter.

In the rod-like member 13 are made a long hole 21 extending axially and having an open end at its upper end and a small hole 22 meeting the long hole 21 at right angles so as to establish communication between a space 23 above the armature 14 and a space defined by the guide hole 11 below the bushing member 12. On the inner surface of the coil bobbin 8 are formed a number of grooves 24 in axial direction to form a gap like passage which communicate between flange surfaces at the upper and lower ends of the coil bobbin 8. In the housing 5 are formed an oblique hole 25 which couples the number of grooves 24 with the spill passage 4. Therefore, the guide hole 11 below the bushing member 12 communicates, via the small hole 22, long hole 21, space 23 above the armature, circumferential gap 15, number of grooves 24 and oblique hole 25, with the spill passage 4. In order to hermetially seal the communicating passage, O-rings 26, 27, 28 and 29 are respectively positioned coaxially between the top plate 17 and the adjusting screw 19, between the top plate 17 and the stator plate 16, between the stator plate 16 and the upper flange portion of the coil bobbin 8, and between the lower flange portion of the coil bobbin 8 and the housing 5, centering the axis of the rod-like member 13. In addition, another O-ring 30 is positioned between the distributor head 2 of the pump body and the housing 5 so that the pump is assembled hermetically.

To an upper end of the housing 5 is telescopically fitted a cover ring 31, and spaces in the housing 5 outside the O-rings 26-29, such as those between the cover ring 31 and the ring 32 and between the winding 9 and the housing 5, are all filled with an epoxy resin 33 so that no space is left, thereby the mechanical strength is bettered while the heat from the winding 9 is effectively dissipated.

Nextly, the structure of the valve portion 102 will be described. The valve portion 102 comprises a first valve whose main elements are pilot valve needle 40 and a pilot valve body 41, functioning as a pilot valve of a small flow rate, and a second valve whose main elements are a main valve spool 42 and a main valve body 43, functioning as a main valve of a large flow rate.

In a cylindrical recess or axial bore made at the lower portion of the housing 5 are telescopically fitted a spacer 44 for adjusting assembling dimension in axial direction, the pilot valve body 41 which is generally holow cylindrical, and a hollow cylindrical main valve body 43. A lower flange portion 46 of the housing 5 is calked to be engaged with a groove 45 provided at the periphery of the main valve body 43 so that the latter is secured.

Within an axial bore of the main valve body 43 is telescopically supported a hollow cylindrical main valve spool 42 to be slidable axially with accuracy to be hermetic. A peripheral portion of a lower end of the main valve spool 42 functions as a main valve head and comes into contact with an annular main valve seat portion 47 positioned close to the bottom of the axial bore of the main valve body 43. The main valve spool 42 is biased by a compression spring 48 downwardly in the drawing, namely in a direction of closing the seat portion 47. When the solenoid valve assembly 1 is mounted on the distributor head 2 of the injection pump, the lower end of the main valve body 43 is mounted on an annular seat plate 49 fixed to the distributor head 2 with the lower end being pressed toward the seat plate 49, and thus a space 50 around the main valve body 43 communicating with the spill passage 4 and the high pressure passage 3 are defined and sealed. At the bottom of the main valve body 43 is made a hole 103 for coupling a high pressure chamber surrounded by the main valve body 43 and the main valve spool 32 with the high pressure passage 3. In the axial bore of the main valve body 43 is formed an annular groove 52 surrounding the seat portion 47 at an immediately lower stream portion of the seat portion 47 so as to form a small chamber. The annular groove 52 communicates via a plurality of transverse holes 53 with peripheral space 50.

Within an axial bore of the cylindrical main valve spool 42 is received a lower portion of the cylindrical pilot valve body 41. A hydraulic chamber 54 is formed by internal surfaces of the main valve spool 42, outer surface of the pilot valve body, and the main valve body 43. The hydraulic chamber 54 is also a spool chamber so that the main valve spool 42 can slide axially, and is also a spring chamber of the compression spring 48. The hydraulic chamber 54 communicates via a small-diameter orifice 55 made at the bottom of the main valve spool 42 with the high pressure chamber 51 which is located at an upper stream portion of the seat portion 47, and also communicates with an opening of a pilot valve seat 56 which is made at the bottom of the pilot valve body 41.

Within the pilot valve body 43 is accurately supported slidably axially the pilot valve needle 40 whose lower end is in contact with an opening 104 at the bottom of the pilot valve body 41 so as to form a seat portion 56 of the pilot valve. The pilot valve needle 40 is biased by way of a compression spring 57 upwardly in the drawing, i.e. in an opening direction of the seat portion 56. The compression spring 57 is equivalent to the above-mentioned second spring 20, and will be referred to as a first spring 57 hereinafter. A flange portion 105 of the pilot valve needle 40 is in contact with a lower end of the rod-like member 13 to be pressed toward the latter. As described in the above, the rod-like member 13 is downwardly biased by the second spring 20, and as a result, the pilot valve needle 40 is biased by a combined force (pressure difference) of the first spring 57 and the second spring 20 downwardly in the drawings, i.e. in an opening direction of the seat portion 56.

The specification, such as spring constant, free length, wire diameter, number of turns, of the first spring 57 is exactly identical with that of the second spring 20, and by adjusting the adjusting screw 19 for changing a set length of the second spring thereby changing the set length of the first spring 57 so as to obtain a biasing force directed upwardly in the drawing with difference in the two spring forces being produced.

A cut-out 58 is formed at a portion of a side surface of the pilot valve needle 40 so that a valve chamber 59 positioned at a lower stream portion of the pilot valve seat portion 56 communicates with the spring chamber 60 in which the first spring 57 is received, and the spring chamber 60 further communicates with the guide hole 11 of the electromagnetic actuator portion. Therefore, fuel passing through the seat portion 56 of the pilot valve flows via the valve chamber 59, cut-out 58, spring chamber 60, guide hole 11, small hole 22 and long hole 21 of the rod-like member 13, space 23 above the armature 14, circumferential gap 15 between the armature 14 and the stator plate 16, number of grooves 24 on the inner surface of the coil bobbin 8, and the oblique hole 25, to reach the spill passage 4.

It is necessary that the flow rate at the seat portion 56 on opening of the pilot valve is larger than the flow rate through the orifice 55 of the main valve spool 42, and the former flow rate is preferably smaller than a value which is 1.5 times the latter flow rate. According to the inventors' experiments desired results have been obtained when the lift amount of the pilot valve needle 40 on opening is 0.1 mm or so, and the diameter of the orifice 55 is between 0.4 mm and 0.6 mm. Furthermore, desired results have been obtained when the lift amount of the main valve spool 42 is between 0.1 mm and 0.5 mm. Moreover, it is preferable that a slight gap is made between the armature 14 and the stator portion 7 in order to give an appropriate pressing force to the pilot vavle needle 40 when the armature 14 it attracted to the satator portion 7 on closure of the pilot valve, i.e. on energization of the winding 9. In order that the slight gap is about 0.1 mm as a preferable value, the thickness of the spacer 44 is selected.

The solenoid valve assembly of FIG. 1 operates as follows. Under a free state where the winding 9 is not being energized and no hydraulic pressure is applied to the high-pressure passage 3, the pilot valve needle 40 is raised upwardly by the combined force of the first spring 57 and the second spring 20, and thus the seat portion 56 of the pilot valve is opened, while the main valve spool 42 is downwardly pressed by the pressing force of the compression spring 48, and thus the seat portion 47 of the main valve is closed as shown in FIG. 1.

On energization of the winding 9 the armature 14 is attracted to the stator portion 7, and thus the rod-like member 13 presses down the pilot valve needle 40 to close the seat portion 56 of the pilot valve. Fuel under high pressure within the high pressure passage 3 sent from an unshown pump enters the high pressure chamber 51 in the solenoid valve assembly 1, and the hydraulic chamber 54 is filled with the fuel which enters therein through the orifice 55 of the main valve spool 42. Since the seat portion 56 of the pilot valve is closed, the hydraulic pressure in the high pressure chamber 51 is equal to that in the hydraulic chamber 54. Considering the hydraulic pressure applied to the main valve spool 42 upwardly and downwardly, the hydraulic pressure acting downwardly (closing direction) with a pressure-receiving area equal to a circle whose diameter equals the outer diameter of the main valve spool 42. On the other hand, the hydraulic pressure acts upwardly (opening direction) with a pressure-receiving area equal to a circle whose diameter equals the diameter of the seat portion 47. Since the outer diameter of the main valve spool 42 is larger than the diameter of the seat 47 as a matter of course, the combined force acting on the main valve spool 42 acts downwardly (closing direction). Therefore, the main valve spool 42 is pressed toward the seat portion 47 with a pressure which increases as the hydraulic pressure within the high pressure chamber 51 increases. As a result, no matter how the fluid pressure in the high pressure passage 3 is high, the seat portion 47 is securely closed and thus leakage of fuel under high pressure is prevented. On the other hand, the seat portion 56 of the pilot valve is desinged so that the flow rate at the seat portion 56 is larger than that through the orifice and smaller than a value which is 1.5 times the flow rate through the orifice 55, as described in the above, and since the diameter of the seat portion 56 is sufficiently small, the force for lifting the pilot valve needle 40 by hydraulic pressure is relatively small, and thus the seat portion 56 can securely be closed by a small attracting force of the armature 14. As a result, parts of the electromagnetic actuator portion 101 forming the electromagnetic solenoid, such as the winding 9, can be miniaturized.

As the energization of the winding 9 is stopped, the armature attracting force disappears, and thus the pilot valve needle 40, which has been depressed by the rod-like member 13, immediately rises with the combined force of the first spring 57 and the second spring 20 as well as the hydraulic pressure applied to the seat portion 56 thereby opening the seat portion 56 of the pilot valve. Then the fuel under high pressure in the hydraulic pressure chamber 54 flows via the seat portion 56, valve chamber 59, cut-out 58, spring chamber 60, guide hole 11, small hole 22, long hole 21, space 23 above the armature 14, circumferential gap 15 between the armature 14 and the stator plate 16, number of grooves 24 on the inner surface of the coil bobbin 8, and oblique hole 25, to reach the spill passage 4. When the fuel passes through the number of grooves 24 on the inner surface of the coil bobbin 8, the fuel takes heat away from the coil bobbin 8 to facilitate heat dissipation from the winding 9. Here, since the flow rate at the valve seat portion 56 is higher than that through the orifice 55, outflow discharge from the seat portion 56 cannot be complemented by inflow through the orifice 55, and thus the pressure in the hydraulic chamber 54 suddenly decreases. As a result, the pressure in the hydraulic pressure chamber 54 becomes much lower than that i the high pressure chamber 51, and thus the main valve spool 42 is pressed upwardly by the pressure within the high pressure chamber 51 to open the large-diameter seat portion 47 of the main valve. Then a large amount of the fluid under high pressure in the high pressure chamber 51 flows to the annular groove 52. This annular groove 52 relaxes the shock of flow of the fuel under high pressure and thus reduces the occurrence of cavitation. The annular groove 52 is used as an escape recess on cutting and machining work of the seat portion 47. The fuel flow into the annular groove 52 then flows out to the space 50 around the main valve body 41 through the plurality of transverse holes 53, and then flows out to the spill passage 4 to complete spill of fuel under high pressure.

The solenoid valve assembly 1 is used with a fuel injection pump of direct spill type, and the operation of such a fuel injection pump having the solenoid valve assembly 1 will simply be described.

Figure 2:
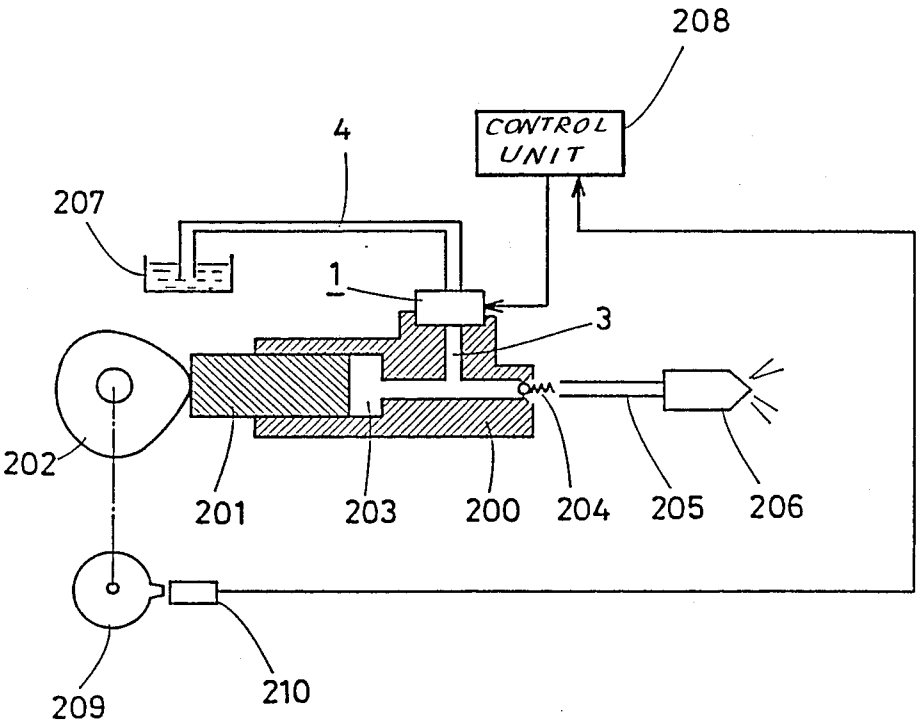
FIG. 2 is a schematic diagram of a fuel injection apparatus having the solenid valve assembly of FIG. 1.

FIG. 2 is a schematic view of an entire structure of the fuel injection apparatus by way of a one-cylider system through simplification. A plunger 201 of a fuel pump 200 compresses, due to the operation of a cam 202, fuel sucked into a pump chamber 203 in advance. On compression stroke of the cam 202 fuel in the pump chamber 203 is injected into an unshown engine combustion chamber from an injection nozzle 206 through dicharge valve 204 and steel tube 205. On the other hand, the pump chamber 203 communicates via the high pressure chamber 3 and the solenoid valve assembly 1 with the spill passage 4 and a pump housing 207 of low pressure. Therefore, when the solenoid valve assembly 1 is closed in the middle of fuel injection, the fuel under high pressure is spilled immediately into the spill passage 4 to terminate fuel injection. Open/close control of the solenoid valve assembly 1 is performed by an electronic control apparatus 208 having a microcomputer. It is arranged that a reference signal is inputted to the electronic control apparatus 208 at each bottom dead center by way of a pulse generating unit including a toothed wheel 209 attached coaxialy to the cam 202 and a reference signal detector 210.

Figure 3:
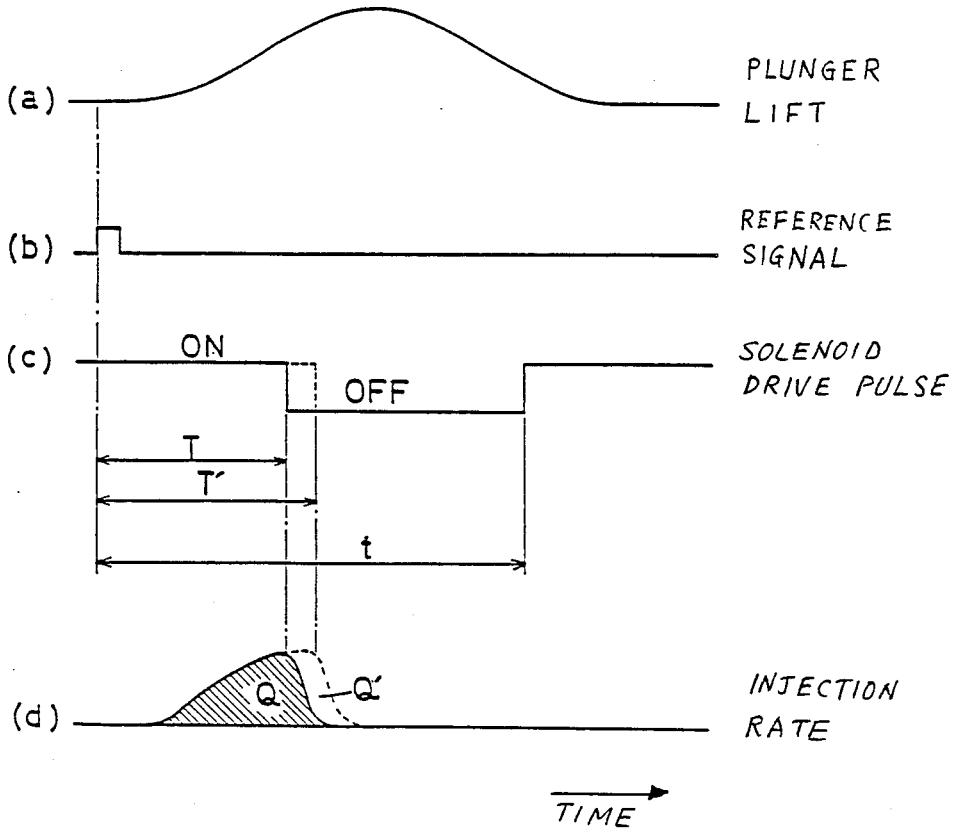
FIG. 3 is a timing chart for describing the operation of the fuel injection apparatus.

FIG. 3 is a timing chart showing the operation, and in the drawing, the reference (a) is a lift amount of the plunger 201; (b), a reference signal; (c), an energization pulse fed to the solenoid valve assembly 1; and (d), rate of injection from the injection nozzle 206.

When the electronic control apparatus 208 terminates the energization of the solenoid valve assembly 1 to cause the same to open after a given rotational angle of the engine from the reference signal, actually after a period of time T has lapsed with the rotational angle being converted into time period within the electronic control apparatus, the fuel under high pressure spills to terminate fuel injection. By changing the opening timing of the solenoid valve assembly, fuel injection amount Q can be controlled. Then, after a given period of time "t", the solenoid valve assembly 1 is energized again to close its valve to be prepared for subsequent fuel injection.

In this way, the solenoid valve assembly according to the present invention has an important feature in that the solenoid valve assembly is opened when energization is stopped. Therefore, in the case that breaking of wire occurs in wires connecting between the electronic control apparatus 208 and the solenoid valve assembly 1, the solenoid valve assembly 1 is left open, and thus the fuel under high pressure in the pluger chamber 203 is spilled completely into the spill passage 4 without being injected from the injection nozzle. As a result, the engine stops and vehicle stops safely. In other words, breaking of wire never lead to dangerous situtation but results in safe situation. Thus, it can be said that the solenoid valve assembly according to the present invention involves fail safe structure. If a solenoid valve assembly of the type arranged to opne on energization, the solenoid valve assembly is kept closed on breaking of wire so that fuel cannot be spilled, and therefore, a large amount of fuel corresponding to the plunger lift amount is injected. Such fuel injection may lead to dangerous situation, and is not desired.

The present invention has the following advantages in addition to those described in the above.

(1) Since the armature 14 is biased upwardly, i.e. valve-opening direction, by the springs 20 and 57, valve opening time lag of the pilot valve needle due to residual magnetism of the stator portion 7 is small, and thus valve response becomes satisfactory.

(2) Since spring means for biasing the pilot vavle needle 40 in an opening direction comprises the first spring 57 and the second spring 20 both have identical specification, and since a biasing force is applied to the pilot valve needle 40 in an opening direction by way of the difference between spring forces caused from the difference in the set lengths of the two springs which are used to bias the pilot valve needle 40 so that the springs oppose each other, it is expected that the first spring 57 and the second spring 20 will change in connection with secular change, and thus the biasing force, which influences sensitively on the response of the solonoid valve assembly, can be held stably for a long period of time therby providing an advantage that response characteristic of a solenoid valve assembly is maintained for a long period of time.

(3) Furthermore, since the adjusting screw 19 for adjusting the set legth of the second spring 20 is provided, the force of biasing the pilot valve needle can be adjusted presicely thereby reducing variation in response time throughout a number of products.

(4) Since fuel flowing out of the pilot valve is arranged to pass through the number of grooves 24 provided on the inner surface of the coil bobbin 8, the coil bobbin 8 is cooled by the passing fuel to facilitate dissipation of heat from the winding 9.

(5) Since the passage for the fuel flowing out of the pilot valve is formed within a space hermetically defined by a plurality of O-rings 26 to 29, which are coaxially arranged centering the axis of the valve, at a portion inside the O-rings 26–29, the winding 9 to be energized can be kept in dry state without being exposed to oil, and therefore, electrical treatment in installation, such as insulation treatment, is easy.

(6) Since the first valve formed of the pilot valve needle 40 and the pilot valve body 41 is received in the axial bore of the main valve spool 42 and the main valve body 43 which form the second valve, the volume of the valve portion including two valves can be made small, and thus the entire solenoid valve assembly can be miniatuarized.

(7) Since the structure is such that the valve portion is received in the housing 5 of the electromagnetic actuator 101 and the flange portion 46 of the housing 5 is calked around the groove 45 provided around the outer periphery of the main valve body 43 to be secured undetachably, it is possible that the valve portion 102, which is a mechanical product, and the electromagnetic actuator 101, which is an electrical product, are respectively manufactured and assembled independently, and these are assembeled into a single unit. Therefore, it is very advantageous in view of manufacturing process.

The above-described embodiment is just an example of the present invention, and therefore, it will be apparent for those skilled in the art that many modifications and variations may be made without departing from the scope of the present invention.

What is claimed is:

1. A high-pressure fluid control solenoid valve assembly for opening and closing a high pressure fluid passage, comprising:

(a) an electromagnetic actuator portion having an armature, a winding, and a stator, which act as an electromagnetic solenoid and form a magnetic circuit; and (b) a valve portion which interrupts flow of fluid under high pressure, said valve portion being spaced apart from said electromagnetic actuator portion, said valve portion having a first valve functioning as a pilot valve of small flow rate and a second valve functioning as a main valve of large flow rate, said first valve being biased normally in opening direction by a first spring, said armature being operatively coupled to said first valve and being biased normally downwardly by a second spring so as to bias said first valve in a closing direction, said first and second springs having equal characteristics including at least spring constant, free length, spring wire diameter and number of turns, whereby said first valve is biased by the resultant force of said first and second springs, a biasing force in a first valve closing direction being obtained by changing the set lengths of said first and second springs, and said second valve being biased normally in closing direction by a third spring, a hydraulic chamber being provided where one wall is made by said second valve, said hydraluic chamber communicating via an orifice provided to said second valve with an upper stream portion from a seat portion of said second valve, said second valve being biased in closing direction by the hydraulic pressure of said hydraulic chamber;

said solenoid valve assembly being formed such that the movement of said armature is transmitted to said first valve by way of a rod-like member fixed to said armature so as to perform unitary movement, said rod-like member being movable within a guide hole made at the center of said stator portion, said high pressure fluid passage being closed with said first valve being closed on energization of said winding and said high pressure fluid passage being opened with said first and second valves being opended on deenergization of the same.

2. A high-pressure fluid control solenoid valve assembly for opening and closing high pressure fluid passage, comprising:

(a) a solenoid unit having a stator, a coil associated with said stator, and an armature arranged to be attracted toward said stator when said coil is energized; and (b) a valve unit axially spaced from said solenoid unit and responsive to the movement of said armature, said valve unit having;

(i) a pilot valve of small flow rate having a pilot valve spool with a pilot valve head at one end thereof and a pilot valve body with a pilot valve seat, said pilot valve spool being slidably received in said pilot valve body so that said pilot valve head comes into contact with said pilot valve seat to close said pilot valve, said pilot valve spool being biased normally in valve-opening direction by a spring;

(ii) a main valve of large flow rate having a main valve spool with a main valve head at one end thereof and a main valve body with a main valve seat, said main valve spool being slidably received in said main valve body so that said main valve head comes into contact with said main valve seat to close said main valve, said main valve spool being biased normally in valve-closing direction by another spring;

at least a portion of said pilot valve body being received in an axial bore of said main valve spool such that a first fluid chamber is formed between an outer surface of said pilot valve body and an inner surface of said main valve spool, said first fluid chamber being communicating via an orifice made in said main valve head with a second fluid chamber defined by said main valve head and bottom of an axial bore of said main valve body, said second fluid chamber being communicating with fluid source to receive fluid under high pressure so that said first and second fluid chambers are filled with fluid when said pilot valve is being closed, said main valve seat having a diameter smaller than the diameter of said first fluid chamber so that said main valve spool is biased in valve-closing direction by the difference in fluid pressure between said first and second fluid chambers;

the movement of said armature being transmitted to said first valve by way of a rod-like member fixed to said armature so as to perform unitary movement, said rod-like member being movable within a guide hole made at the center of said stator, said high pressure fluid passage being closed with said first valve being closed on energization of said winding and said high pressure fluid passage being opened with said first and second valves being opend on deenergization of the same.

3. A fuel injection apapratus with an improved solenoid valve assembly for use with an internal combustion engine, said fuel injection apparatus comprising:

(a) a distributor pump for injecting fuel from a fuel source into one or more cylinders of said internal combustion engine through compression of fuel with a plunger driven in synchronism with engine rotation;

(b) reference angle signal generating means responsive to the movement of said plunger;

(c) an electronic control unit responsive to said reference angle signal for producing an output signal with which fuel amount to be injected is determined; and (d) a high-pressure fluid control solenoid valve assembly for opening and closing high pressure fluid passage in said distributor pump, said solenoid valve assembly having:

(i) an electromagnetic actuator portion having an armature, a winding, and a stator, which act as an electromagnetic solenoid and form a magnetic circuit; and (ii) a valve portion which interrupts flow of fluid under high pressure, said valve portion being spaced apart from said electromagnetic actuator portion, said valve portion having a first valve functioning as a pilot valve of small flow rate and a second valve functioning as a main valve of large flow rate, said first valve being biased normally in opening direction by a first spring, said armature being operatively coupled to said first valve and being biased normally downwardly by a second spring so as to bias said first valve in a closing direction, said first and second springs having equal characteristics including at least spring constant, free length, spring wire diameter and number of turns, whereby said first valve is biased by the resultant force of said first and second springs, a biasing force in a first valve closing direction being obtained by changing the set lengths of said first and second springs, and said second valve being biased normally in closing direction by a third spring, a hydraulic chamber being provided where one wall is made by said second valve, said hydraulic chamber communicating via an orifice provided to said second valve with an upper stream portion from a seat portion for said second valve, said second valve being biased in closing direction by the hydraulic pressure of said hydraulic chamber;

said solenoid valve assembly being formed such that the movment of said armature is transmitted to said first valve by way of a rod-like member fixed to said armature so as to perform unitary movement, said rod-like member being movable within a guide hole made at the center of said stator portion, said high pressure fluid passage being closed with said first valve being closed on energization of said winding and said high pressure fluid passage being opened with said first and second valves being opended on deenergization of the same.

4. A high-pressure fluid control solenoid valve assembly as claimed in claim 1, wherein said rod-like member is made of a nonmagnetic material, and hardening is effected at a sliding surface and a portion to be contact with a member of said valve portion of said rod-like member.

5. A high-pressure fluid control solenoid valve assembly as claimed in claim 1, further comprising a bushing member made of a hard material which bushing member is interposed between a guide hole made at the center of said stator and the sliding surface of said long member.

6. A high-pressure fluid control solenoid valve assembly as claimed in claim 1, further comprising an adjusting screw with which the set length of said second spring can be adjusted from outside.

7. A high-pressure fluid control solenoid valve assembly as claimed in claim 1, wherein said first valve is received in said second valve.

8. A high-pressure fluid control solenoid valve assembly as claimed in claim 1, wherein said valve portion having said first and second valves is received in a housing of said electromagnetic actuator portion, said valve portion and said electromagnetic actuator portion, which can be respectively assembled independently, being assembled into a single unit such that said housing is secured to a member of said valve portion through calking of said housing after both are put together.

9. A high-pressure fluid control solenoid valve assembly as claimed in claim 1, wherein an axially extending long hole opened at the head of armature and a small hole intersecting at right angles and communicating with said long hole which small hole is opened at a lower portion of said rod-like member so that an upper stream portion and a lower stream portion of said rod-like member are communicated with each other to form a hydraulic passage from said first valve.

10. A high-pressure fluid control solenoid valve assembly as claimed in claim 1, wherein a circumferential gap is provided around said armature, a gap-like passage being provided to be continuous from said circumferential gap between said stator and a coil bobbin telescopically engaged so as to surround said stator, a hole for communicating between said gap-like passage and outside of said valve being provided so that said gap-like passage and said hole are used for communicating an upper portion of said armature with the outside of said solenoid valve assembly to form a hydraulic passage from said first valve.

11. A high-pressure fluid control solenoid valve assembly as claimed in claim 10, wherein said gap-like passage provided between said stator portion and said coil bobbin is formed of a number of grooves formed axially on inner surface of said coil bobbin.

12. A high-pressure fluid control solenoid valve assembly as claimed in claim 9, wherein said hydraulic passage communicating between said first valve and outside of said solenoid valve assembly is formed in a space which is hermetically limited by way of a plurality of O-rings coaxially arranged centering the axis of said valve among a housing of said electromagnetic actuator, flange portions at both end surfaces of said coil bobbin, and said stator plate.

13. A high-pressure fluid control solenoid valve assembly as claimed in claim 1, wherein a small hydraulic chamber is formed of an annular groove which surrounds seat of said second valve functioning as a main valve of large flow rate, at an immediatedly lower stream portion of said seat portion, so that fluid flowing out of said second valve is discharged via said small hydraulic chamber to the outside of said valve portion.

14. A high-pressure fluid control solenoid valve assembly as claimed in claim 2, wherein a circumferential gap is provided around said armature, a gap-like passage being provided to be continuous from said circumferential gap between said stator and a coil bobbin telescopically engaged so as to surround said stator, a hole for communicating between said gap-like passage and outside of said valve being provided so that said gap-like pasage and said hole are used for establishing communication between an upper portion of said armature and the outside of said solenoid valve assembly to form a hydraulic passage from said first valve, said gap-like passage being formed of a number of grooves formed axially on inner surfaces of said coil bobbin.

15. A fuel injection apparatus as claimed in claim 3, wherein a circumferential gap is provided around said armature, a gap-like passage being provided to be continuous from said circumferential gap between said stator and a coil bobbin telescopically engaged so as to surround said stator, a hole for communicating between said gap-like passage and outside of said valve being provided so that said gap-like passage and said hole are used for establishing communication between an upper portion of said armature and the outside of said solenoid valve assembly to form a hydraulic passage from said first valve, said gap-like passage being formed of a number of grooves formed axially on inner surface of said coil bobbin.

* * * * *